US005230501A

United States Patent [19]

Melton

[11] Patent Number: 5,230,501

[45] Date of Patent: Jul. 27, 1993

[54] APPARATUS AND METHOD FOR INTEGRATING AN INSERT ASSEMBLY ON A PRINTING PRESS

[75] Inventor: James P. Melton, Hartland, Wis.

[73] Assignee: Quad/Tech, Inc., Sussex, Wis.

[21] Appl. No.: 821,800

[22] Filed: Jan. 16, 1992

[51] Int. Cl.[5] ..... B41L 43/04; B65H 39/00

[52] U.S. Cl. ..... 270/41; 270/52; 270/52.5

[58] Field of Search ..... 270/1.1, 5, 7, 12, 16, 270/17, 20.1, 21.1, 32, 37, 38, 41, 42, 43, 44, 48, 51, 53, 55, 57, 52, 52.5

[56] References Cited

U.S. PATENT DOCUMENTS

| | | | |
|---|---|---|---|
| 2,213,157 | 8/1940 | Brenn | 270/52 |
| 2,812,005 | 11/1957 | Koenig | 270/52 X |
| 3,284,077 | 11/1966 | Matuschke | 270/5 |
| 3,588,085 | 6/1971 | Bailey et al. | 270/37 |
| 4,279,409 | 7/1981 | Pemberton | 270/32 X |
| 4,824,503 | 4/1989 | Wilen | 270/37 X |
| 4,901,993 | 2/1990 | Hansch | 270/21.1 |
| 5,021,273 | 6/1991 | Kobayashi | 270/5 X |

FOREIGN PATENT DOCUMENTS

| | | | |
|---|---|---|---|
| 3725370 | 2/1989 | Fed. Rep. of Germany | 270/52 |

*Primary Examiner*—Edward K. Look
*Assistant Examiner*—John Ryznic
*Attorney, Agent, or Firm*—William L. Falk

[57] ABSTRACT

An apparatus and method for forming an insert assembly on a printing press includes at least one processing mechanism for delivering at least one first ribbon defining an insert and at least one second ribbon defining at least a binding hanger, and a fastening arrangement for joining the first ribbon and the second ribbon to facilitate attachment of the insert to at least one signature during a perfect binding or saddle stitching operation.

23 Claims, 13 Drawing Sheets

APPARATUS AND METHOD FOR INTEGRATING AN INSERT ASSEMBLY ON A PRINTING PRESS

TECHNICAL FIELD

The present invention relates generally to an apparatus and method used in the production of magazines or other publications and, more particularly, to an apparatus and method for integrating the assembly of a removable insert for a magazine or publication "on-line" in a printing operation.

BACKGROUND OF THE INVENTION

There is a need for a magazine insert which can be readily removed from the primary or parent magazine without damage to the binding thereof or to the insert itself. Modern economics provides a demand for inserts in magazines to advertise various products through the use of brochures or small magazines which can be readily detached from the primary magazine. Two desirable attributes of such an insert are that, upon removal from the parent or primary magazine, it not damage the binding of the primary magazine and that it provide a bound article acceptable in form and condition to the trade. Heretofore most known inserts often fail in one or both of these respects.

There are a limited number of ways commonly accepted for binding a magazine. One is known as perfect binding wherein the edges of each sheet are burred to facilitate the absorption of glue applied thereto to hold all of the pages or sheets together and secure the pages or sheets to a cover. The other method most commonly used is known as saddle-stitching wherein each sheet is folded to produce two pages and the superimposed sheets are stitched with a staple or by other suitable means at the fold line.

Each of the above methods has the disadvantage of requiring a separate operation for each insert in order to secure the insert to the primary magazine into which the insert is to be placed. For example, with perfect binding it may be necessary to destroy or at least seriously damage the binding of the primary magazine if the insert is to be torn therefrom in bound form. In an effort to avoid this, some producers have glued a tab or hanger along the edge of the binding of the insert in a separate operation remote from the standard printing press folding and cutting machine on which the insert is formed, and then the assembly is glued into the binding of the primary magazine. With saddle-stitching, a separate operation attaching the insert to the primary magazine is also required, and the stitching of the primary magazine is destroyed or seriously damaged when the insert is torn therefrom.

Another method of providing a magazine insert is shown in Bailey, et al. U.S. Pat. No. 3,588,085 issued Jun. 28, 1971. By this process, the insert is made by applying adhesive at different locations to opposite sides of a sheet in ribbon form along opposite sides of a pair of spaced longitudinally extending perforations. The ribbon is folded upon itself transversely a number of times with standard printing press folding and cutting machine equipment, depending upon the number of pages desired in the end product. Then the ribbon is cut or folded longitudinally and appropriately trimmed to produce an insert particularly adapted for securement into the primary magazine by perfect binding or saddle-stitching, as desired. The problem with this process, however, is that the edges of the detachable insert are always loose and rough after being torn from the perforation lines. In addition, because of the location of the adhesive relative to the perforation lines, the insert is not a "lay flat" design and therefore can never provide a so-called "perfect two page spread" because the pages of the insert are glued and when opened will always be bowed. Moreover, this insert does not include any reply or response capability for the sender such as a removable reply card or the like.

Accordingly, it is desirable that the folding and cutting apparatus of a printing press be designed to eliminate the separate off-line operation of providing a tab or hanger for the insert and enable a readily removable insert assembly having improved appearance and functional characteristics.

SUMMARY OF THE INVENTION

The present invention advantageously provides an improved processing capability for the folding and cutting apparatus used in the high speed printing of inserts for magazines and publications. The improved folding and cutting apparatus provides noteworthy cost savings and is readily adaptable into existing systems with a minimum of modification.

These and other advantages are realized, in one aspect of the invention, by an apparatus for forming an insert assembly for at least one signature on a printing press having a processing machine for supplying a web separable into at least one first ribbon and at least one second ribbon. A ribbon feeding mechanism delivers at least one first ribbon and at least one second ribbon from the processing machine while a fastening arrangement joins the first ribbon and the second ribbon together along one edge to form an insert assembly such that either the first ribbon or the second ribbon defines an attachment device for securing the insert assembly to the at least one signature.

The present invention also relates to a method for forming an insert assembly on a printing press having a processing machine for supplying a web separable into at least one first ribbon and at least one second ribbon. The method includes the steps of delivering at least the first ribbon from the processing machine, delivering at least the second ribbon from the processing machine, and joining at least the first ribbon and the second ribbon together on the printing press to form an insert assembly such that either the first ribbon or the second ribbon defines an attachment device for securing the insert assembly to the at least one signature.

The present invention further contemplates an apparatus and method for forming an insert assembly for at least one signature on a printing press having a first processing machine for supplying at least a first ribbon and a second processing machine for supplying at least a second ribbon. A fastening arrangement joins the first ribbon and second ribbon together along one edge to form an insert assembly such that either the first ribbon or the second ribbon defines an attachment means for securing the insert assembly to the at least one signature.

In a highly preferred embodiment, the first ribbon forms an insert attachable to and detachable from the at least one signature and the second ribbon defines a binding hanger for facilitating attachment of the insert to the at least one signature during a perfect binding or saddle stitching operation. In one version the second ribbon comprises an elongated strip which serves only as a binding hanger. In other versions, the second ribbon comprises a perforated sheet which functions as a combination binder hanger and reply card.

BRIEF DESCRIPTION OF THE DRAWINGS

The invention will be described with reference to the appended drawings, wherein like numerals denote like elements, and.

DETAILED DESCRIPTION OF THE PREFERRED EMBODIMENT

Figure 1:
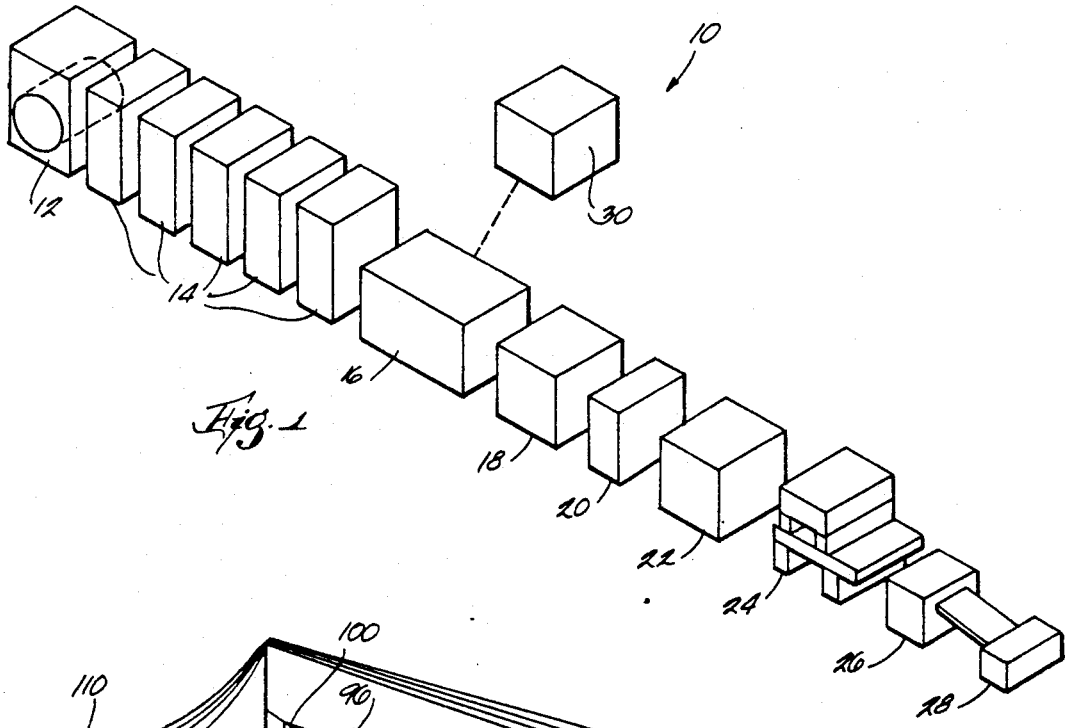
FIG. 1 is a schematic block diagram of a printing press employing the present invention.

Referring first to FIG. 1, the diagrammatic representation of a typical web printing press 10 shows a supply for web material indicated generally at 12. In a typical installation this may include supports for multiple rolls of paper or other web material, whereby one or more webs may be supplied and threaded through the press simultaneously. For example, a typical commercial multicolor offset printing press may print simultaneously on both sides of two different webs, which may even be of dissimilar grades of paper. In a typical embodiment this supply may be in the form of a well known mechanism known in the art as a splicer which includes provision to support rolls of web material fed into two different accumulator devices (not shown). Thus, webs from two different rolls can each be fed into an accumulator, and thence into the press as later described, additional rolls of like material can be ready, and when the first webs are depleted the webs from the rolls in reserve can be pasted to the tail of the webs which are depleting while the press momentarily draws web material from the accumulators. Such devices, which are well known, permit the press to continue operation through two or more subsequent rolls of web material, since the reserve rolls can be used while new additional rolls are placed in the position of the fully depleted rolls. At the outlet of the accumulator there is conventionally an infeed mechanism (not shown), which in general controls the web payout into the printing unit of the press, and which may incorporate known types of tension control devices to assure an essentially constant tension in the web material.

From the infeed, the webs are threaded through one or more printing units of the press. In the diagram these are indicated schematically at item 14, representative of five printing units for a five color perfecting web press. Each printing unit includes the usual upper and lower printing equipment for printing on opposite sides of the web material threaded therethrough, and these include upper and lower blanket cylinders, plate cylinders, inkers, dampeners, etc. which are well known.

The printed web material enters a dryer unit 16 which includes conventional upper and lower heated drying equipment for the web. Following the drying unit is a chill roll device 18 having chill rolls which receive and cool the web material leaving the dryer, and following the chill rolls there may be web perforating equipment 20 as for applying a tear line to the web material. Finally the web material passes into folding and/or cutting equipment 22, 24 where the web material may be folded lengthwise, folded across its width and separated into individual signatures, and from the folders the material may pass to a rotary cutter 26 for trimming and then conventional stackers or other suitable delivery equipment 28.

The printing press generally described above is controlled by a conventional computer or programmable controller 30, the details of which are well known in the art. The foregoing description of a typical press is provided by way of background, and it should be understood that various types of web handling equipment are within the scope of the invention, including different forms of printing equipment such as lithographic, gravure, or other printing processes.

Figure 2:
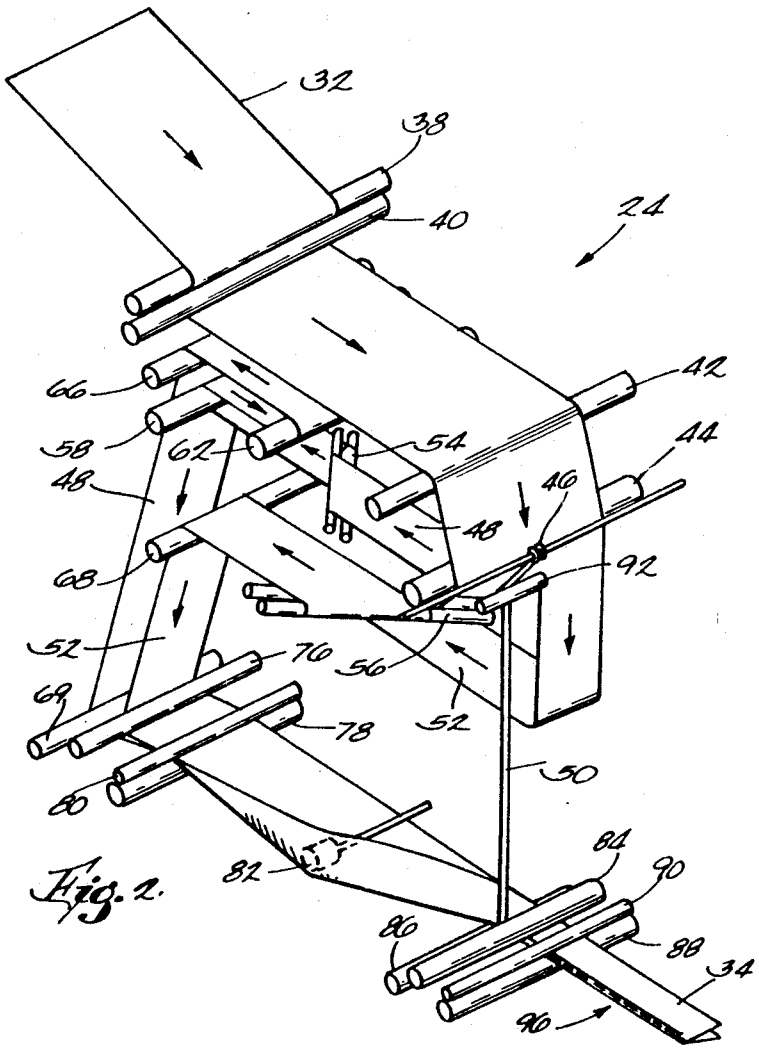
FIG. 2 is a fragmentary, perspective view of a folding and cutting apparatus shown in FIG. 1 with various portions exaggerated to more clearly distinguish the ribbons used in the present invention.
Figure 3:
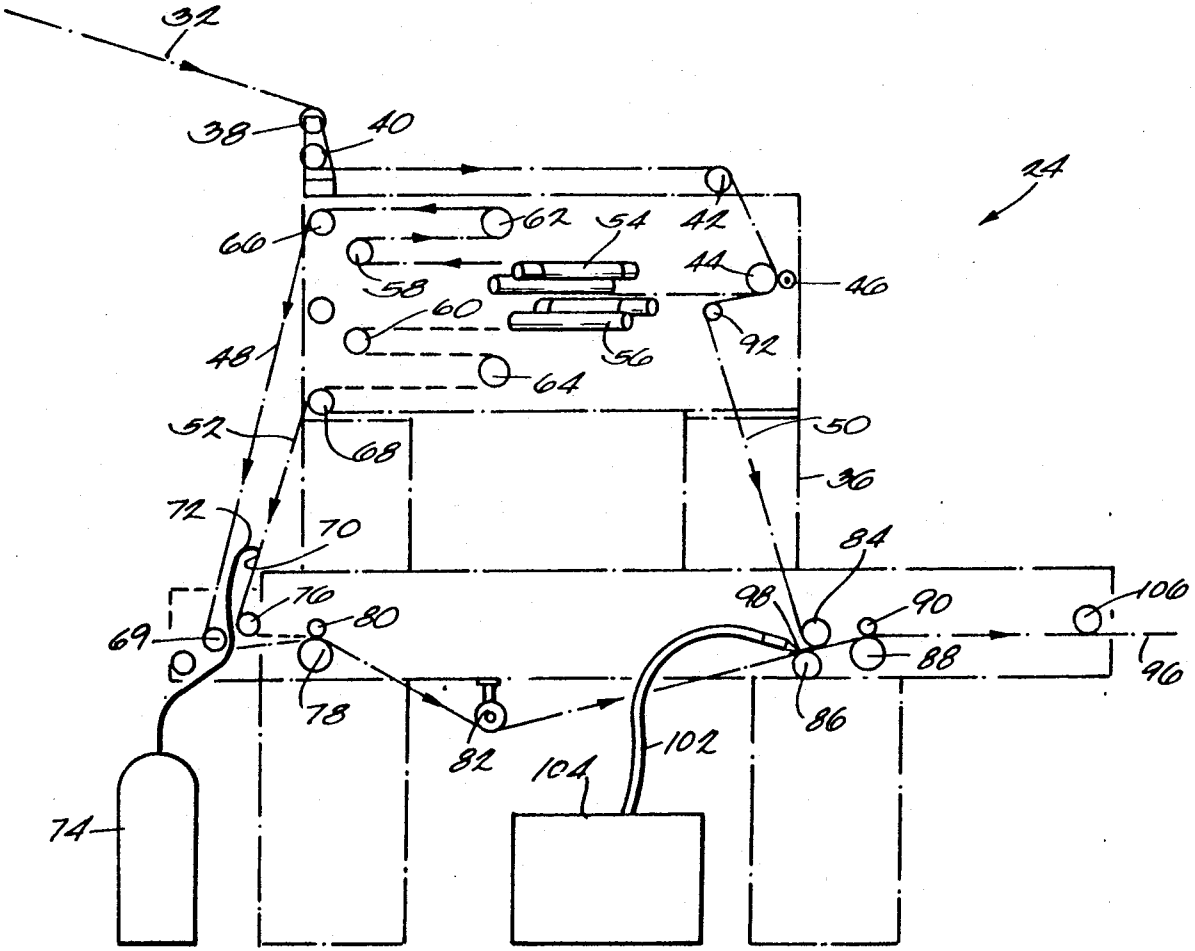
FIG. 3 is a side view of the folding and cutting apparatus shown in FIG. 2.

Turning now to FIGS. 2 and 3, folding and cutting apparatus 24 embodying the present invention is known in the printing industry as an angle bar ribbon shifter and plow fold station. The established purpose of apparatus 24 is to process a web (or webs) 32 after being printed so that it can be separated into ribbons which are associated or interleaved before they are folded, joined, trimmed and delivered as an insert 34 comprised of one or more signatures normally used in supplementation of a primary magazine or similar publication.

Apparatus 24 includes a framework 36 having a series of idler rollers, driven rollers, compensator rollers and angle bar ribbon shifters for leading web 32 along one or more serpentine paths. In particular, web 32 is wrapped around idler rollers 38, 40, 42 and passes into a nip formed by a driven slitter roller 44 and a slitter knife 46. At this point, printed web 32 is slit lengthwise into a first ribbon 48, a second ribbon 50 and a third ribbon 52, with FIG. 2 illustrating an exaggerated separation of first ribbon 48 and third ribbon 52 to better explain their unique paths of travel. In actuality, FIG. 3 correctly shows first ribbon 48 directly laterally adjacent third ribbon 52 in the initial horizontal runs of ribbons 48, 52 respectively. First ribbon 48 and third ribbon 52 then travel into respective angle bar ribbon shifters 54, 56, around respective idler rollers 58, 60, respective compensator rollers 62, 64, and respective idler rollers 66,68. As is well known, ribbon shifters 54, 56 serve to associate first ribbon 48 and third ribbon 52 one on top of the other, while compensator rollers 62, 64 lengthen and shorten the alignment travel distance of these same ribbons.

When alignment between first ribbon 48 and third ribbon 52 has been attained, first ribbon 48 runs downwardly uninterrupted around idler roller 69. The third ribbon 52 likewise travels downwardly, during which passage a strip 70 of relatively quick-drying glue is applied medially to third ribbon 52 via a dispensing line 72 connected to a glue tank 74. After glue has been applied, third ribbon 52 wraps around an idler roller 76 and proceeds to be joined in substantially flat, superimposed registration with aligned first ribbon 48 at a nip defined by a driven roller 78 and an associated idler roller 80. The glue applied from tank 74 exhibits a tremendous bonding strength which is intended to provide substantially permanent adhesion of first ribbon 48 with respect to third ribbon 52. Such non-solvented or water-base spine and pocket adhesive is commercially sold as 3719RB or 3719C by Craig Adhesives Co. The joined first and third ribbons 48, 52 are then folded by a standard plow shoe 82 and directed between a pair of idler rollers 84, 86 and into a nip formed between a final driven roller 88 and a cooperating idler roller 90. Finally, the elongated, joined first and third ribbons 48, 52 are transferred to rotary cutter 26 (FIG. 1) to be sized as desired and then led into stacker 28. First and third ribbons 48, 52 respectively, are thus processed in a conventional manner to form a mini-magazine or insert 34 capable of inclusion in a primary magazine.

Figure 4:
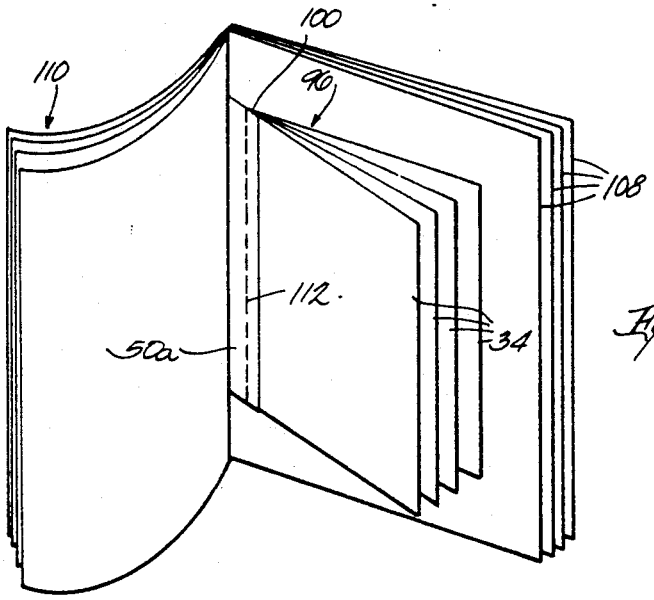
FIG. 4 is a rear, perspective view of an insert assembly formed by the present invention.
Figure 5:
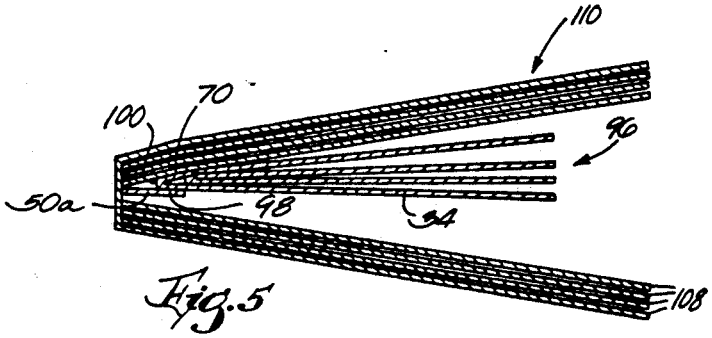
FIG. 5 is a top view of the insert assembly shown in FIG. 4.

According to the invention, second ribbon 50 wraps around an idler roller 92, traverses downwardly in a continuous line and winds about idler roller 84. At this location, second ribbon 50 and joined first and third ribbons 48, 52 are instantly merged together again in substantially flattened condition and joined adhesively to form an insert assembly 96 by means of a strip 98 of hot glue dispensed adjacent a longitudinal edge or fold line 100 of insert 34 as shown in FIGS. 4 and 5. Hot glue is delivered through a line 102 connected with a glue tank 104 just as joined first and third ribbons 48, 52 reach idler roller 84. This hot glue is markedly different from the adhesive used to join first and third ribbons 48, 52 in that it is preferably formulated to provide high shear strength, low viscosity and low peel strength. This means the hot glue is easily peelable or releasable to facilitate substantially non-destructible separation of joined first and third ribbons 48, 52 from second ribbon 50 as will be further discussed hereafter. Such adhesive is commercially sold as hot melt 70-3704 and 34-2602 by National Starch and Chemical Company. Upon exiting from idler rollers 84, 86, the joined first, second and third ribbons 48, 50, 52 pass between the nip formed by driven roller 88 and cooperating idler roller 90 and under idler roller 106 and then are sized and stacked as previously described before further processing with fixed or variable length cutting equipment.

Second ribbon 50 defines at least a binding hanger and separation strip 50*a* for facilitating attachment of printed insert 34 comprised of joined first and third ribbons 48, 52 respectively to at least one or more signatures 105 forming a primary magazine 110 as seen in FIGS. 4 and 5. In the embodiment described above, second ribbon 50 comprises a elongated strip having a width significantly less than that of first and third ribbons 48, 52 respectively, and a longitudinal axis 112 along which edge 100 of the joined first and third ribbons 48, 52 respectively is preferably fastened. With this apparatus, the present invention totally integrates the formation of insert assembly 96 on a conventional printing press.

In use, insert assembly 96 is generally comprised of various advertising or the like and is particularly adapted for a perfect binding operation where the edges of each signature of primary magazine 110 and binding hanger 50*a* are burred to facilitate the absorption of glue thereto to hold all the magazine signatures and insert assembly 96 together. Once insert assembly 96 is bound into primary magazine 110 via binding hanger 50*a* as depicted in FIG. 4, a reader may choose to easily remove insert 34 without harm to either insert 34 or primary magazine 110 by simply peeling and separating insert 34 from binding hanger 50*a* along adhesive strip 98 (FIG. 5), it being understood that the integrity of insert 34 is maintained by permanent adhesive 70. In the preferred embodiment, insert 34 is comprised of eight pages but this is due to the particular number of ribbons and the particular folding used and it is contemplated that various other inserts may be formed as desired. For example, it is certainly feasible in this embodiment and further embodiments to be described to process only first ribbon 48 unfolded as a one page insert to which second ribbon 50 is joined to form a suitable insert assembly 96.

Referring now to FIGS. 6–9, one alternative embodiment of the invention for producing a ten page detachable insert will now be described. Primed numbers are used in these figures to indicate elements of the alternative embodiments which generally correspond to previously numbered elements appearing in FIGS. 2–5. Apparatus 24' is employed to process web 32' which has been previously perforated along a line 115 at perforator 20 of printing press 10. Web 32' is again separable into three ribbons 48', 50', 52' respectively, second ribbon 50' being wider than originally described second ribbon 50 and carrying perforation line 115 located inwardly adjacent one longitudinal edge thereof. After web 32' has been slit, first ribbon 48' initially travels through angle bar ribbon shifter 56', around idler roller 60', compensator roller 64' and idler roller 68' while third ribbon 52' runs horizontally and wraps around an idler roller 116. From this point, first and third ribbons 48', 52', are generally adhesively joined and folded as before described. Second ribbon 50' passes through angle bar ribbon shifter 54', around idler roller 58', compensator roller 62' and idler roller 66' and then runs downwardly around idler rollers 118, 119 and upwardly around driven roller 88'. Second ribbon 50' then proceeds around an idler roller 120 and receives a strip 70' of quick drying glue along a line generally parallel with and spaced inwardly from perforation line 115. A tank 74' having a dispensing line 72' is provided to meter the quick drying glue 70' on second ribbon 50' which merges with joined first and third ribbons 48', 52' at idler rollers 122 inside rotary cutter 26 and is permanently fixed thereto.

Figure 8:
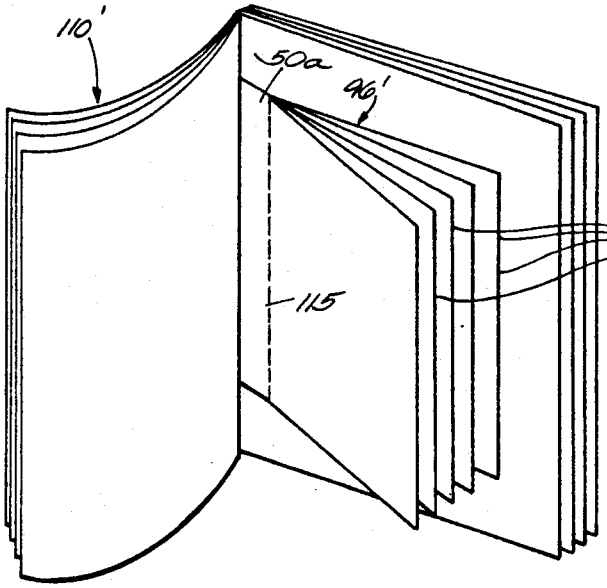
FIG. 8 is a rear perspective view of the insert assembly formed by the apparatus of FIG. 6.
Figure 9:
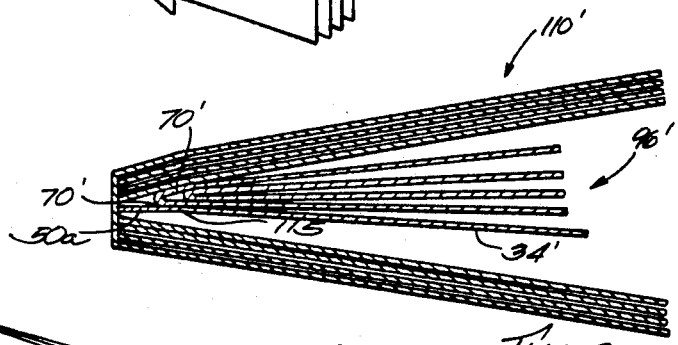
FIG. 9 is a top view of the insert assembly of FIG. 8.

The resulting product as shown in FIGS. 8 and 9 is insert assembly 96' comprising a ten page insert 34' which is perfectly bound into primary magazine 110' by projecting edge 50a' of second ribbon 50' which serves as a binding hanger. Insert 34' is easily and non-destructably removed from magazine 110' by tearing the insert 34' along perforation line 115, the pages of insert 34' being tightly held together by both permanent glue strips 70'.

Figure 10:
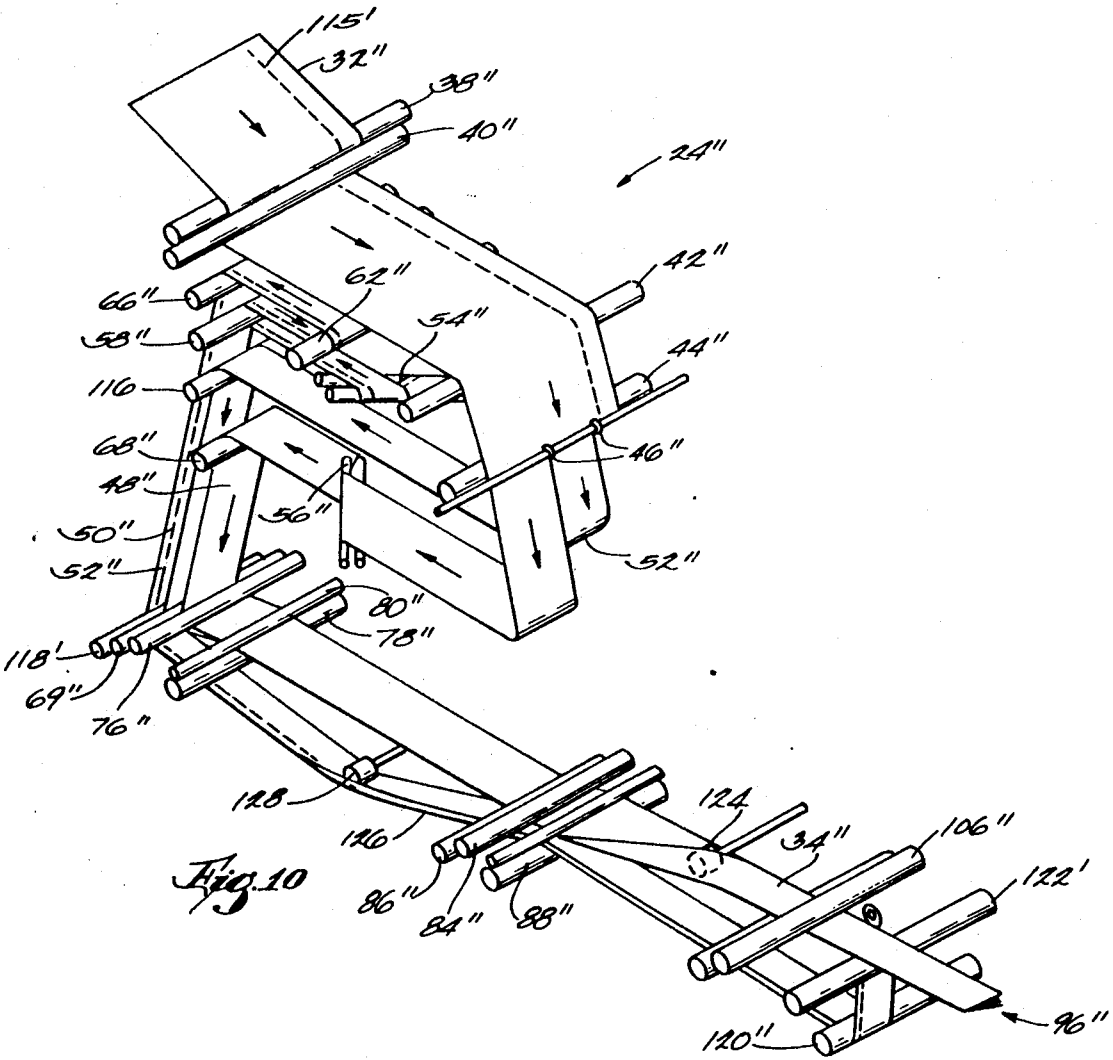
FIG. 10 is a view similar to FIG. 2 showing a second alternative embodiment of the invention.
Figure 11:
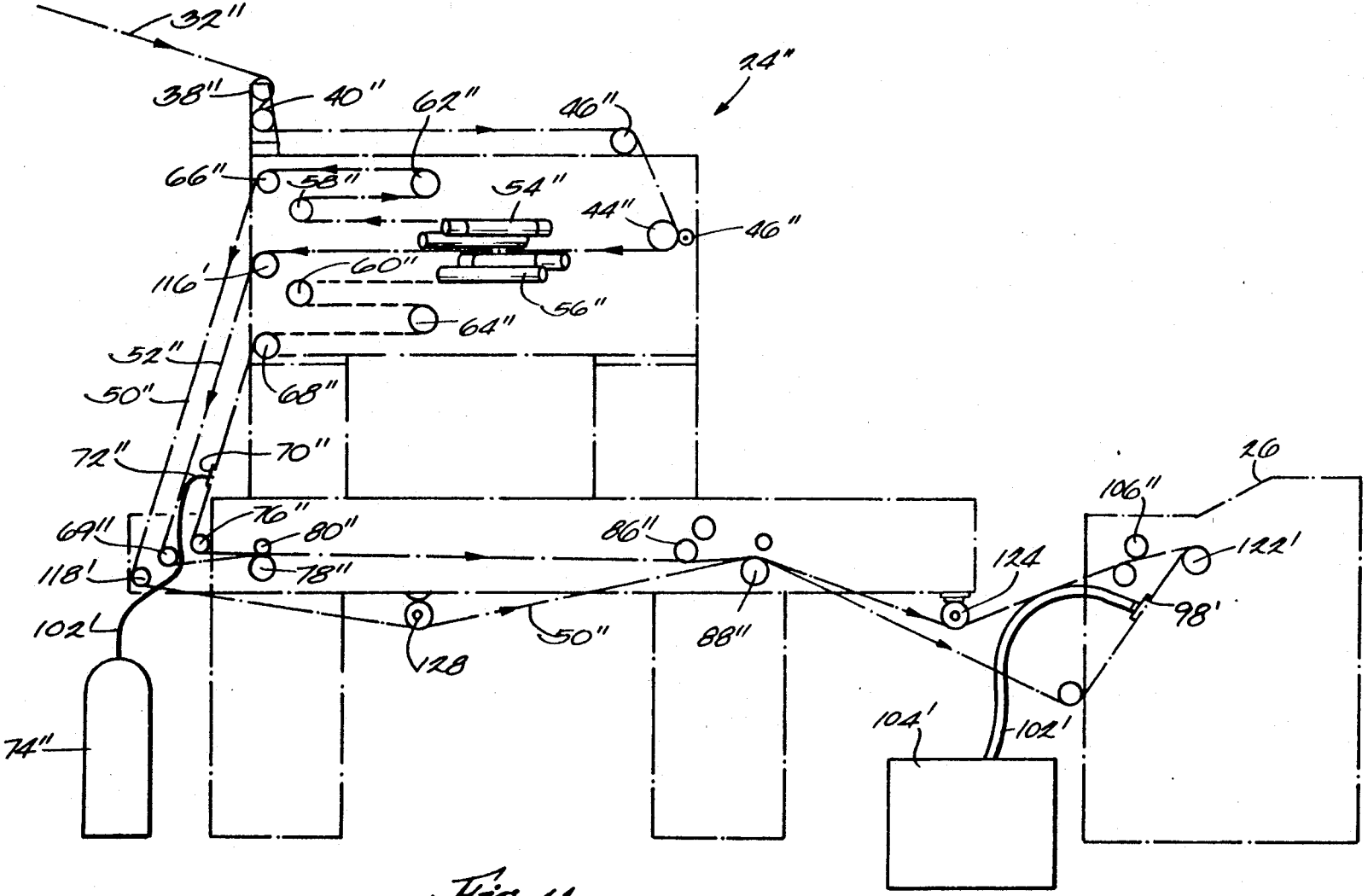
FIG. 11 is a side view of the folding and cutting apparatus shown in FIG. 10.

FIGS. 10–17 illustrate second and third embodiments of the invention which contemplate a removable response or redemption capability (such as a response card) in combination with a detachable insert. In FIGS. 10 and 11, apparatus 24" is utilized to process web 32" into three ribbons, second ribbon 50" again being provided with perforation line 115' located inwardly adjacent one longitudinal edge thereof. Ribbons 48", 52" generally follow similar winding paths as described in FIGS. 6 and 7 with the exception of joined first and third ribbons 48", 52" being folded medially at a downstream plow shoe 124. Second ribbon 50" also follows a similar circuitous route as described in FIGS. 6 and 7 with the exception that an edge fold 126 is provided at plow shoe 128 and that a peelable glue strip 98" is applied along the folded edge 126. Folded and glued second ribbon 50" is then combined at a driven roller 122' with joined first and third ribbons 48", 52" along a line spaced inwardly from back bone 130 of joined first and third ribbons 48", 52". Perforation line 115' extends parallel to folded edge 126 on the side opposite folded edge along which first and third ribbons 48", 52" are joined.

Figure 12:
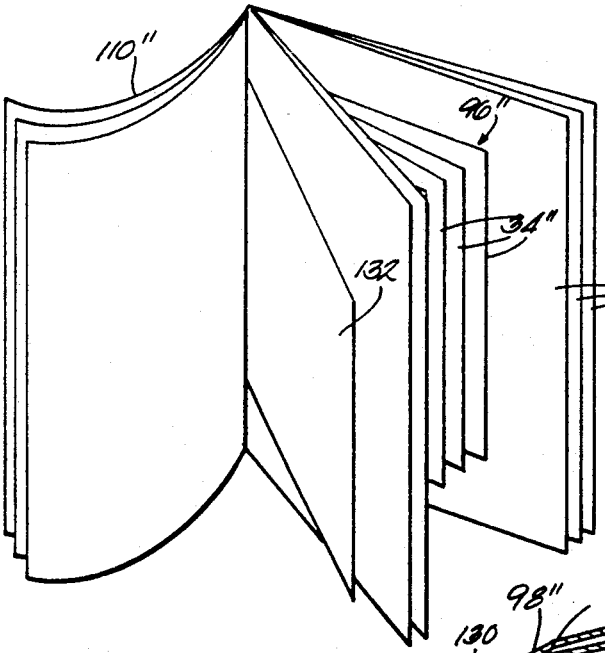
FIG. 12 is a rear, perspective view of the insert assembly formed by FIG. 10.
Figure 13:
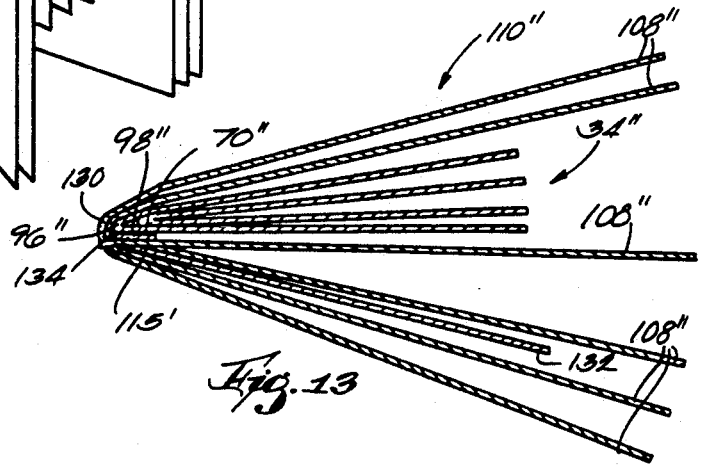
FIG. 13 is a top view of the insert assembly of FIG. 12.

The resulting product as illustrated in FIGS. 12 and 13 is an insert assembly 96" comprising a removable eight page insert 34" combined with a separated, detachable reply card or redemption coupon 132. Insert assembly 96" is conventionally saddle stitched into a primary magazine 110" by inserting a series of staples 134 through back bone 136 of primary magazine 110' and through either the joined first or third ribbons 48", 52", forming insert 34" or folded second ribbon 50" forming the combination binding hanger and reply or redemption card 132. It should be appreciated that this embodiment is particularly versatile in locating insert 34" between two selected pages of primary magazine 110" and alternately positioning reply card between two other selected pages of primary magazine 110". With this arrangement, a reader may easily peel insert 34" from strip 98" and/or may remove reply card or redemption coupon 132 by tearing along perforation line 115'. Either or both of these operations may occur without damaging insert 34" or primary magazine 110'.

Figure 6:
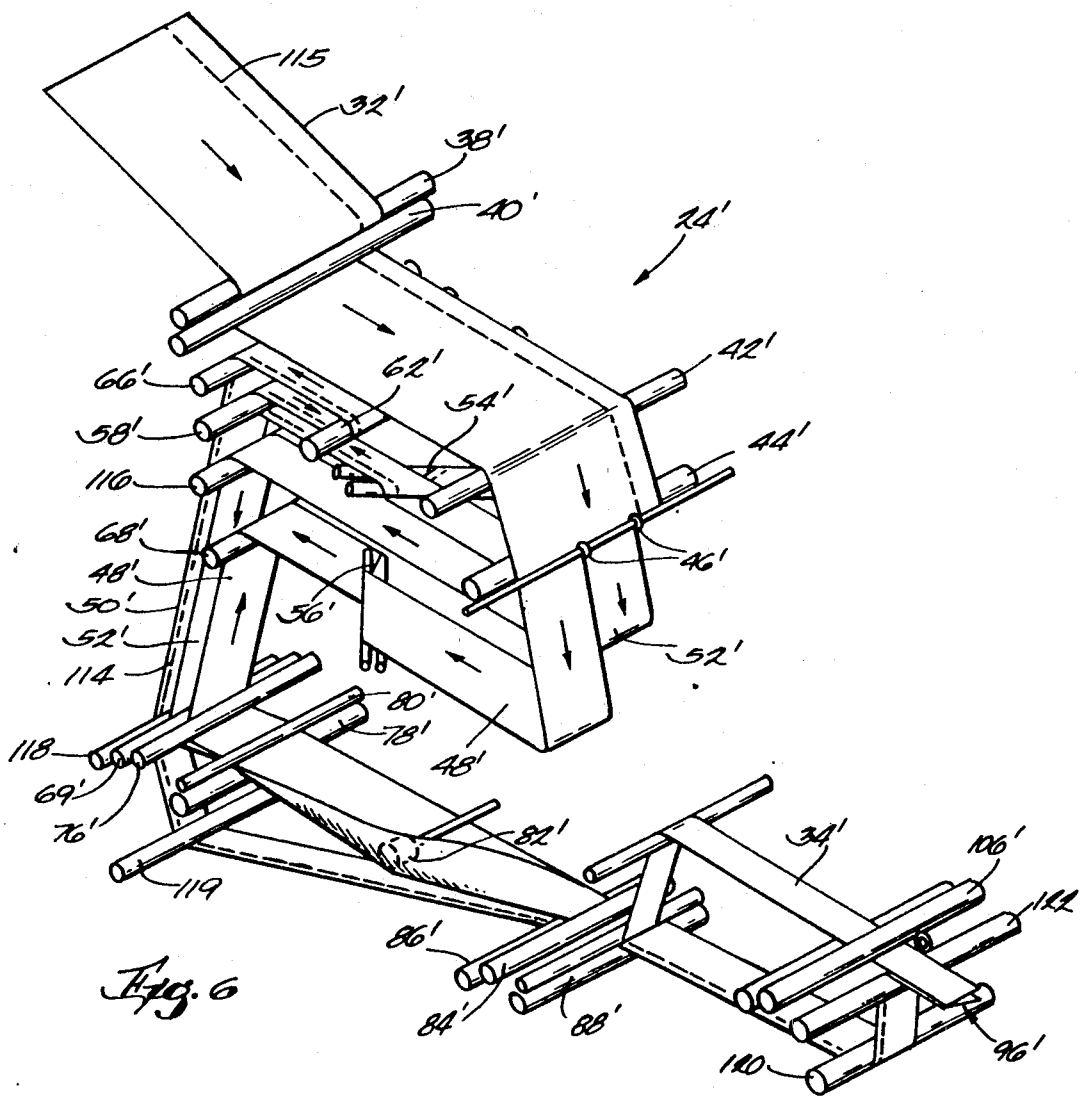
FIG. 6 is a view similar to FIG. 2 showing a first alternative embodiment of the invention.
Figure 7:
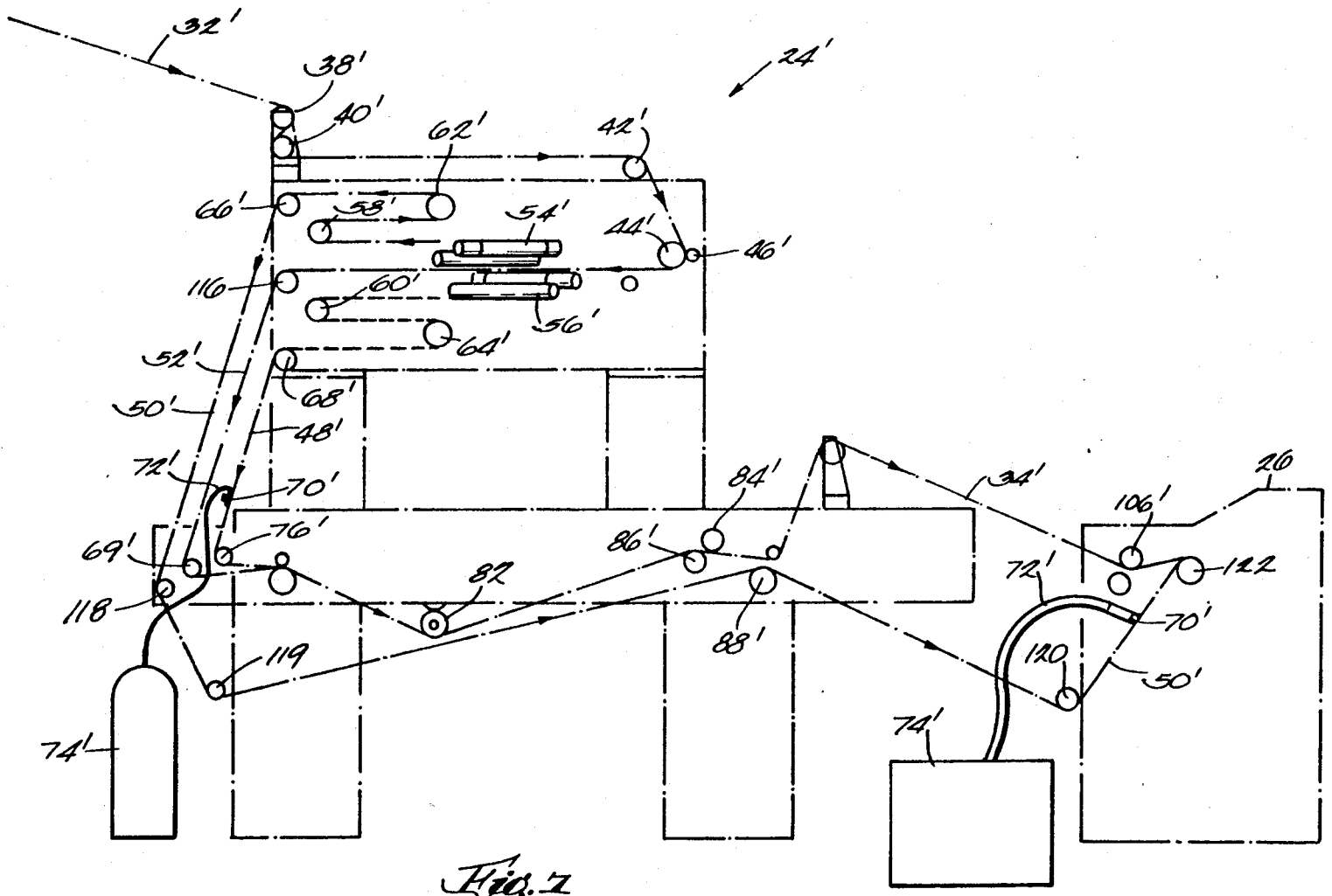
FIG. 7 is a side view of the folding and cutting apparatus shown in FIG. 6.
Figure 14:
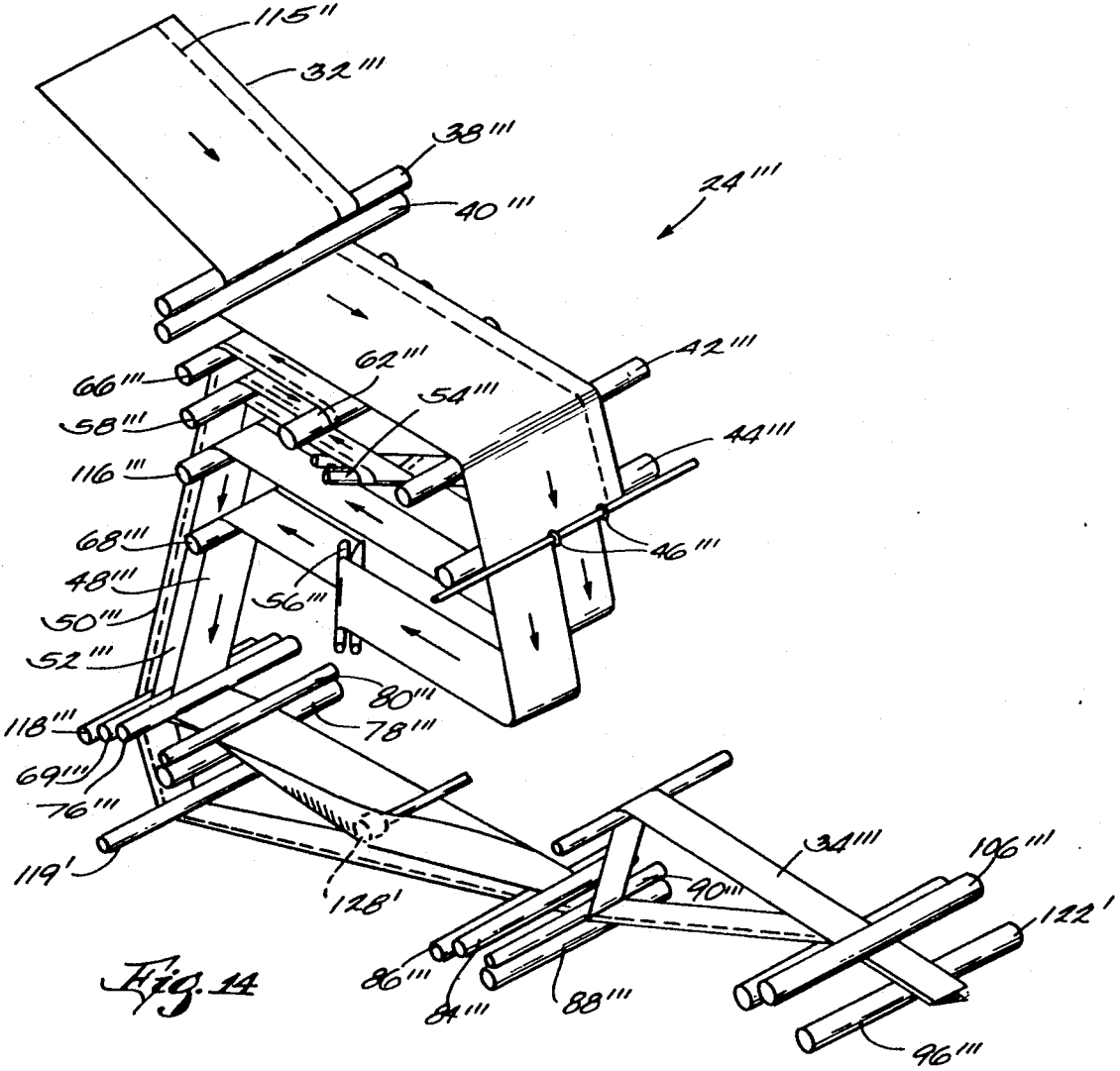
FIG. 14 is a view similar to FIG. 2 showing a third alternative embodiment of the invention.
Figure 15:
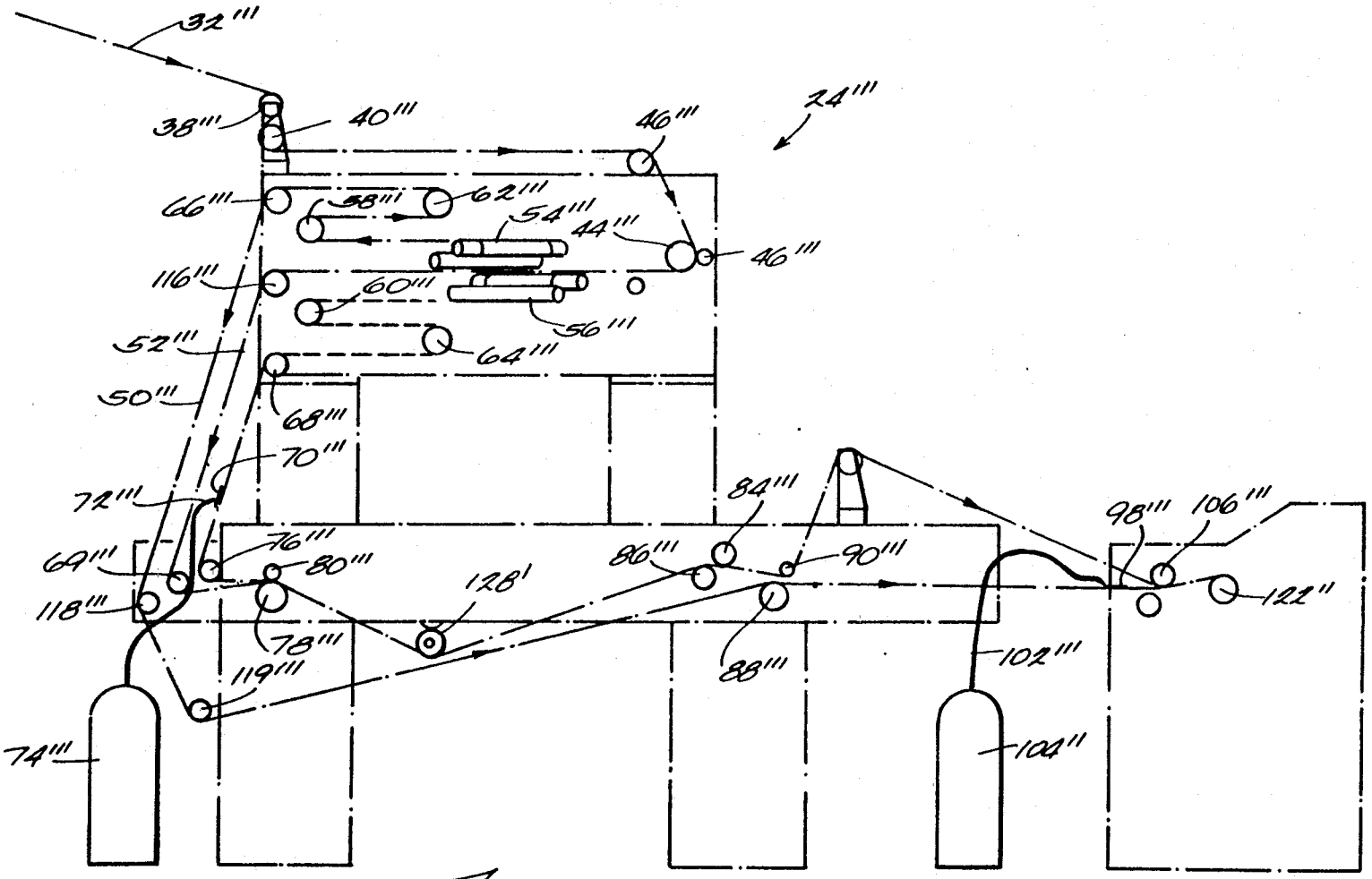
FIG. 15 is a side view of the folding and cutting apparatus shown in FIG. 14.

In FIGS. 14 and 15, ribbons 48''', 52''' generally travel along tortuous routes as described in FIGS. 6 and 7 with the exception that second ribbon 50''' receives a strip 98''' of peelable glue so that backbone of joined and folded first and third ribbons 48''', 50''', is adhesively fastened to perforated second ribbon 50''' along a line substantially parallel to and spaced outwardly of perforation line 115".

Figure 17:
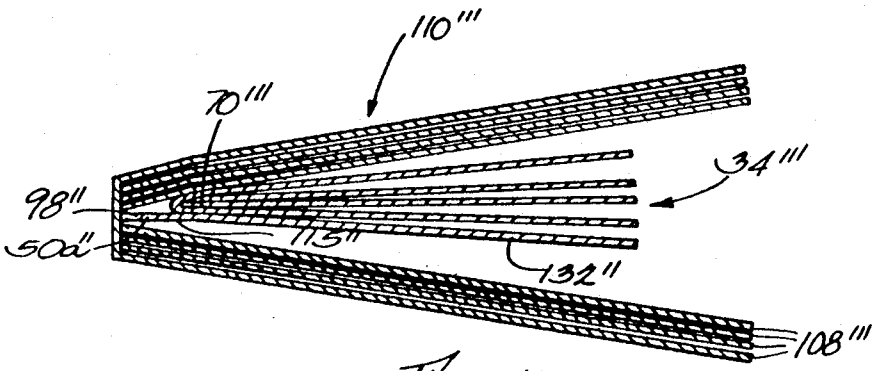
FIG. 17 is a top view of the insert assembly of FIG. 16.
Figure 16:
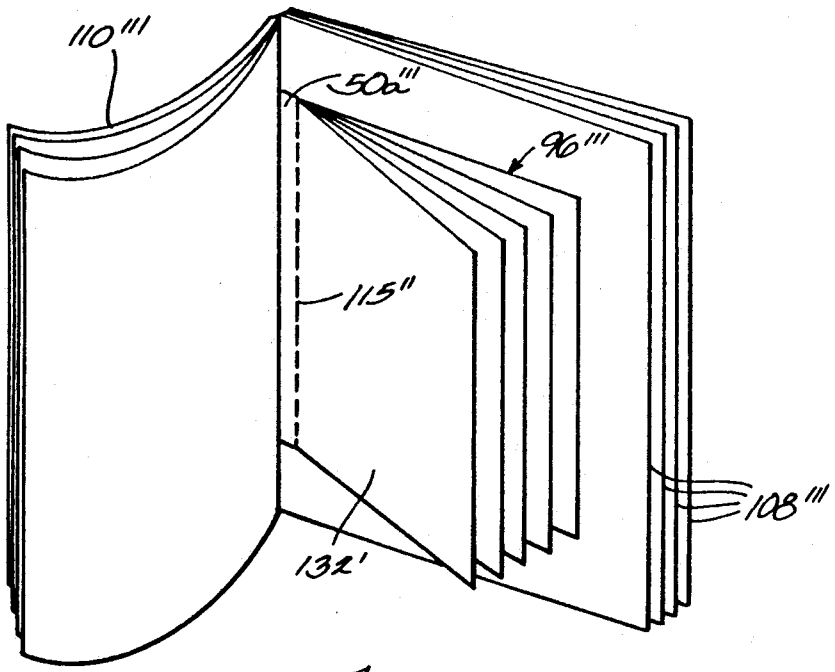
FIG. 16 is a rear perspective view of the insert assembly formed in FIG. 14.

The resulting product as reflected in FIGS. 16 and 17 is an another insert assembly 96''' comprising a releasable eight page insert 34''' including a separately removable reply card or redemption coupon 132". Insert assembly 96''' is perfectly bound into primary magazine 110''' by means of the binding hanger or portion 50a''', of second ribbon 50''' projecting beyond the back bone of formed insert 34'''. With this insert assembly 96''', a reader may again peel insert from strip 98''' or remove combined insert 34''' and reply and or coupon 132" by tearing along perforation line 115''' without any deleterious effect.

Figure 18:
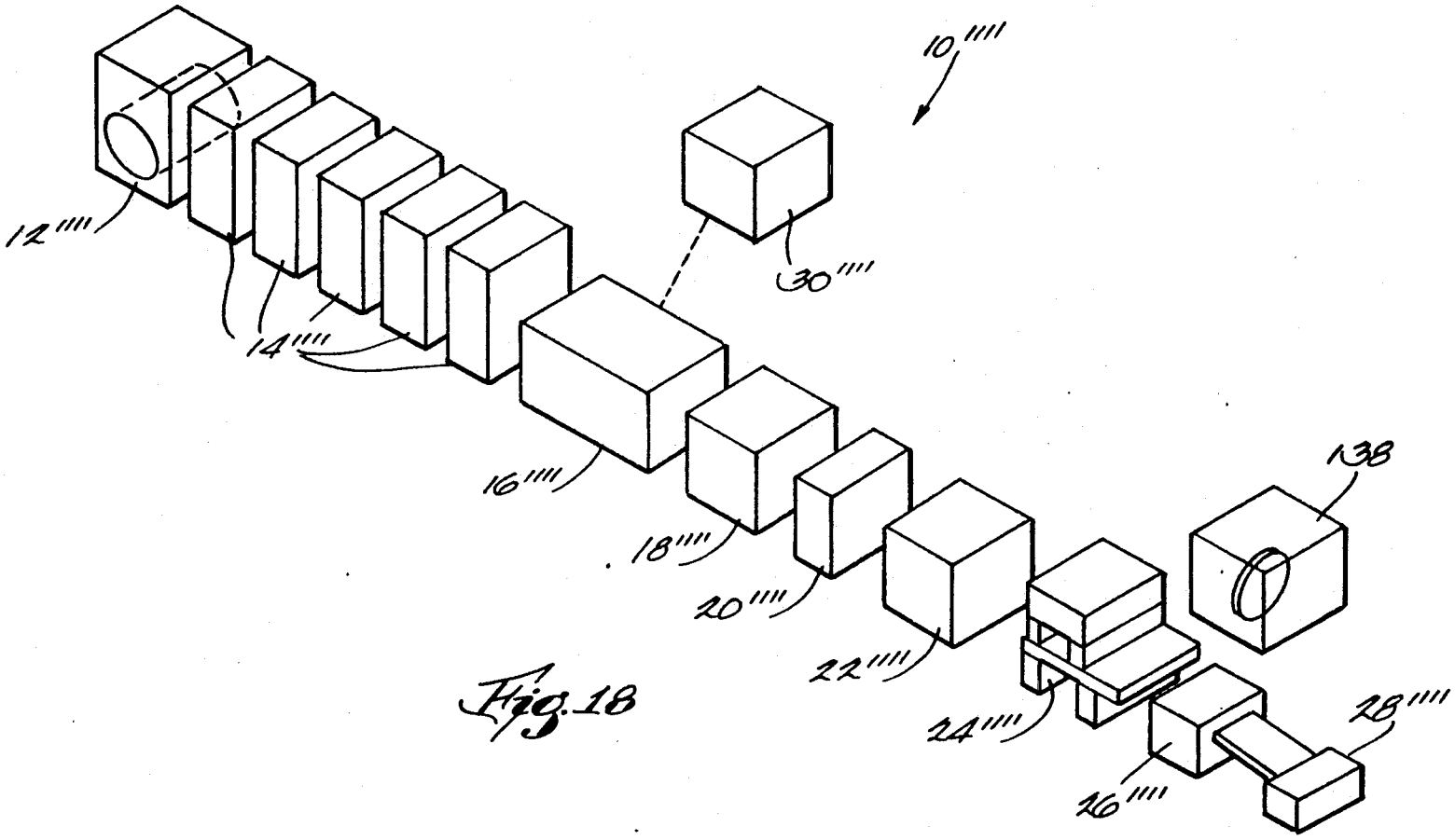
FIG. 18 is a schematic block diagram of a printing press including a fourth alternative embodiment of the invention.
Figure 19:
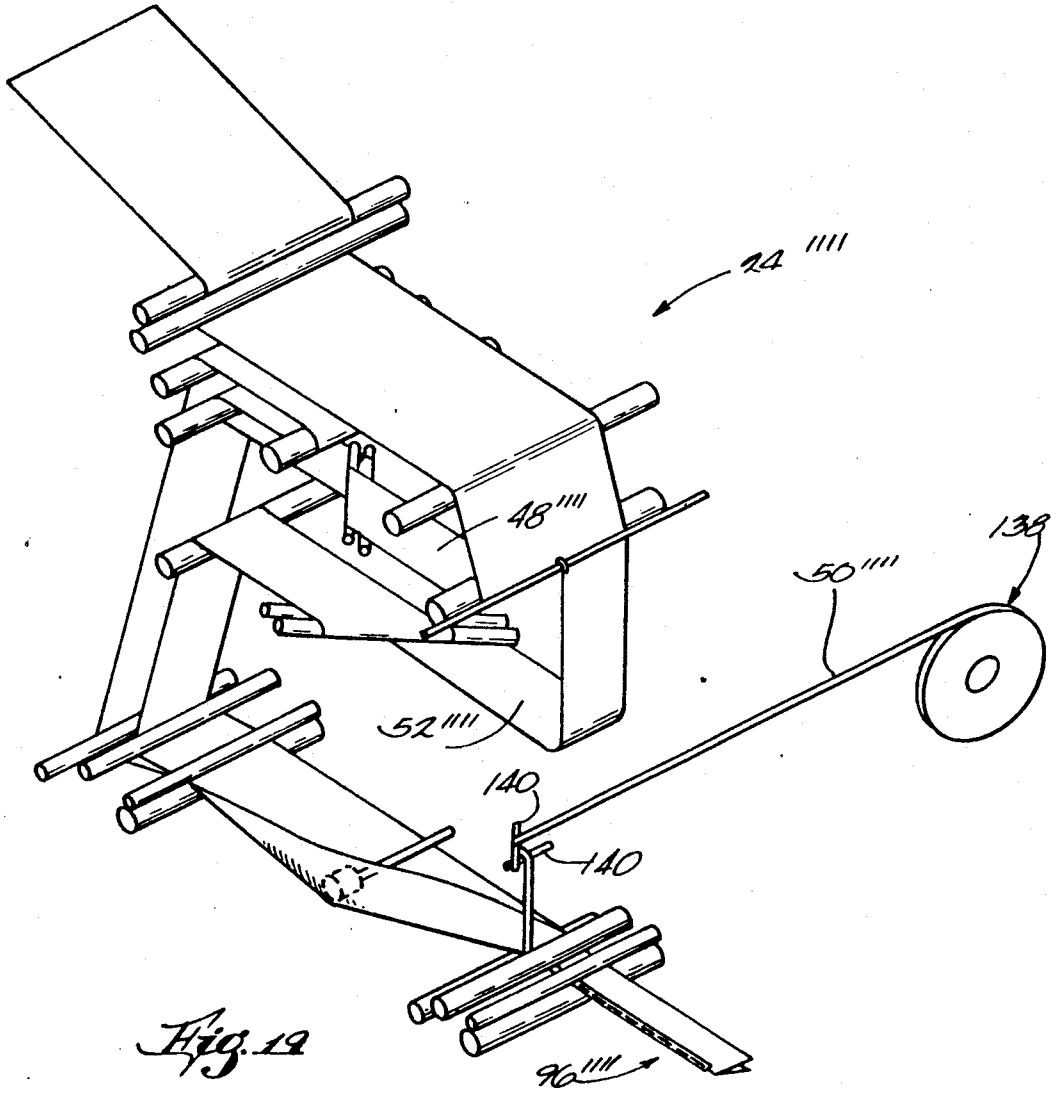
FIG. 19 is a view similar to FIG. 2 showing a fourth alternative embodiment of the invention.

FIGS. 18 and 19 depict a fourth alternative embodiment of the invention similar to FIG. 2 in which second ribbon 50'''' is delivered from a second processing machine 138 included on printing press 10 via diverting guides 140. First ribbon 48'''' and third ribbon 52'''' are delivered from first processing machine 24'''' and are joined to second ribbon 50'''' as previously described to yield an insert assembly 96'''' as shown in FIGS. 4 and 5.

It should be appreciated that the present invention greatly enhances the capability of a printing press by incorporating the ability to form a complete insert assembly useful in both perfect binding and saddle stitching applications without further need for off-line operation. Such capability is attained without significant losses in operating speed and without creating additional problems in signature handling. The preferred form of the invention is easily adaptable to existing folding and cutting apparatus on printing presses and continues to offer versatility in handling webs of various weights, sizes and finishes.

Unlike prior art inserts which have loose, rough edges and need to be held open, the present invention contemplates an insert assembly having an insert with a more rounded back bone to facilitate a perfect two page spread or "lay flat" design easier to handle and read. With this innovative arrangement, in-line insert preparation and off-line binding hanger assembly is combined which considerably improves savings over separate operations.

While the invention has been described with reference to certain preferred embodiments, those skilled in the art will appreciate that certain substitutions, alterations and omissions may be made without departing from the spirit thereof. Accordingly, the foregoing description is meant to be exemplary only and should not be deemed limitative on the scope of the invention set forth in the following claims.

I claim:

1. An apparatus for forming an insert assembly for at least one signature on a printing press having a processing means for supplying a web separable into at least one first ribbon and at least one second ribbon, said apparatus comprising:

ribbon feeding means for delivering said at least one first ribbon and said at least one second ribbon from said processing means; and fastening means for joining said at least one first ribbon and said at least one second ribbon together along one edge of said first ribbon to form an insert assembly such that either said first ribbon or said second ribbon defines an attachment means for securing said insert assembly to said at least one signature, said first ribbon comprising an insert attachable to and detachable from said at least one signature and said second ribbon comprising a binding hanger facilitating attachment of said insert to said at least one signature.

2. The apparatus of claim 1, wherein the apparatus includes a plowing means for folding said first ribbon prior to said joining of said first ribbon to said second ribbon.

3. The apparatus of claim 1, wherein the apparatus includes an adhesive means for applying glue between said first ribbon and said second ribbon.

4. The apparatus of claim 1, wherein said first ribbon is substantially separable from said second ribbon after said joining of said first ribbon to said second ribbon.

5. The apparatus of claim 1, wherein said second ribbon comprises an elongated strip having a longitudinal axis along which the edge of said first ribbon is joined.

6. An apparatus for forming an insert assembly for at least one signature on a printing press having a processing means for supplying a web separable into at least one first ribbon and at least one second ribbon, said apparatus comprising:

ribbon feeding means for delivering said at least one first ribbon and said at least one second ribbon from said processing means; and fastening means for joining said at least one first ribbon and said at least one second ribbon together along one edge of said first ribbon to form an insert assembly such that either said first ribbon or said second ribbon defines an attachment means for securing said insert assembly to said at least one signature;

wherein said second ribbon comprises a detachable reply sheet having a folded edge along which the edge of said first ribbon is joined and a perforation line extending parallel to said folded edge on the side opposite the folded edge along which said first ribbon is joined.

7. An apparatus for forming an insert assembly for at least one signature on a printing press having a processing means for supplying a web separable into at least one first ribbon and at least one second ribbon, said apparatus comprising:

ribbon feeding means for delivering said at least one first ribbon and said at least one second ribbon from said processing means; and fastening means for joining said at least one first ribbon and said at least one second ribbon together along one edge of said first ribbon to form an insert assembly such that either said first ribbon or said second ribbon defines an attachment means for securing said insert assembly to said at least one signature;

wherein said second ribbon comprises a flat, detachable reply sheet having a portion projecting beyond said one edge of said first ribbon and a perforation line extending parallel to the edge along which said first ribbon is joined.

8. An apparatus for forming an insert assembly for at least one signature on a printing press having a processing means for supplying a web separable into at least one first ribbon, one second ribbon and one third ribbon, said apparatus comprising:

ribbon feeding means for delivering said at least one first ribbon, one second ribbon and one third ribbon from said processing means; and fastening means for joining said first ribbon and said third ribbon together in substantially superimposed registration, and then joining said second ribbon along an edge of said joined first ribbon to form an insert assembly so that either said joined first ribbon and said third ribbon or said second ribbon defines an attachment means for securing said insert assembly to said at least one signature.

9. The apparatus of claim 8, wherein the apparatus includes a plowing means for folding said joined first ribbon and said third ribbon prior to said joining of said second ribbon to said joined first ribbon and said third ribbon.

10. The apparatus of claim 8, wherein the apparatus includes an adhesive means for joining said first ribbon, said second ribbon and said third ribbon.

11. The apparatus of claim 10, wherein said adhesive means includes a first adhesive means for applying glue to said first ribbon and said third ribbon.

12. The apparatus of claim 10, wherein said adhesive means includes a second adhesive means for applying glue between said joined first ribbon and said third ribbon and said second ribbon.

13. The apparatus of claim 11, wherein said first adhesive means includes a first adhesive delivery means for applying a quick drying glue, said quick drying glue having a bonding strength intended to provide a substantially permanent adhesion of said first ribbon with said third ribbon.

14. The apparatus of claim 12, wherein said second adhesive means includes a second adhesive delivery means for applying a peelable glue, said peelable glue having a peel strength appropriate to facilitate substantially non-destructible separation of said joined first ribbon and said third ribbon to said second ribbon.

15. The apparatus of claim 10, wherein said adhesive means includes a first adhesive delivery means and a second adhesive delivery means for applying a quick drying glue, said quick drying glue having a bonding strength intended to provide a substantially permanent adhesion of said first ribbon, said second ribbon and said third ribbon.

16. The apparatus of claim 8, wherein the apparatus includes shifting means for changing the travel direction of said first ribbon and said third ribbon.

17. The apparatus of claim 8, wherein the apparatus includes compensating means for adjusting the travel distance of said first ribbon and said third ribbon.

18. A method for forming an insert assembly for at least one signature on a printing press having a processing means for supplying a web separable into at least one first ribbon and at least one second ribbon, said method comprising the steps of:

delivering at least said one first ribbon from said processing means, said first ribbon comprising an insert attachable to and detachable from said at least one signature; and delivering at least said one second ribbon from said processing means, said second ribbon comprising a binding hanger facilitating attachment of said insert to said at least one signature; and joining at least said one first ribbon and said one second ribbon together on said printing press along one edge of said first ribbon to form an insert assembly such that either said first ribbon or said second ribbon defines an attachment means for securing said insert assembly to said at least one signature.

19. The method of claim 18, wherein said method includes the step of delivering at least a third ribbon from said processing means.

20. The method of claim 19, wherein said method includes the step of joining said first ribbon and said third ribbon together in substantially superimposed registration.

21. The method of claim 20, wherein said method includes the step of joining said second ribbon along an edge of said joined first ribbon and said third ribbon such that a portion of said second ribbon extends beyond the edge of said joined first ribbon and said third ribbon.

22. An apparatus for forming an insert assembly for at least one signature on a printing pres, said apparatus comprising:

a first processing means for supplying at least a first ribbon, said first ribbon comprising an insert attachable to and detachable from said at least one signature;

a second processing means for supplying at least a second ribbon, said second ribbon comprising a binding hanger facilitating attachment of said insert to at least one signature; and fastening means for joining said at least one first ribbon and said at least one second ribbon together along one edge of said first ribbon to form an insert assembly such that either said first ribbon or said second ribbon defines an attachment means for securing said insert assembly to said at least one signature.

23. A method for forming an insert assembly for at least one signature on a printing press said method comprising the steps of:

delivering at least a first ribbon from a first processing means, said first ribbon comprising an insert attachable to and detachable from said at least one signature;

delivering at least a second ribbon from a second processing means, said second ribbon comprising a binding hanger facilitating attachment of said insert to at least one signature; and joining at least said one first ribbon and said one second ribbon together on said printing press along one edge of said first ribbon to form an insert assembly such that either said first ribbon or said second ribbon defines an attachment means for securing said insert assembly to said at least one signature.

* * * * *